US007708186B2

(12) United States Patent
Pawlick

(10) Patent No.: US 7,708,186 B2
(45) Date of Patent: May 4, 2010

(54) LIQUID-IN-BOX CONTAINER

(75) Inventor: Adam Pawlick, Omaha, NE (US)

(73) Assignee: ConAgra Foods RDM, Inc., Omaha, NE (US)

( * ) Notice: Subject to any disclaimer, the term of this patent is extended or adjusted under 35 U.S.C. 154(b) by 673 days.

(21) Appl. No.: 11/601,905

(22) Filed: Nov. 20, 2006

(65) Prior Publication Data

US 2008/0116206 A1 May 22, 2008

(51) Int. Cl.
*B65D 33/38* (2006.01)
*B65D 25/30* (2006.01)
*B65D 25/40* (2006.01)

(52) U.S. Cl. ..... 229/117.3; 220/495.05; 220/770; 222/572

(58) Field of Classification Search ..... 229/117.3, 229/122.23, 122.24, 117.35, 117.09, 117.15, 229/117.27, 122.3; 220/495.05, 495.01, 220/761; 206/596, 598
See application file for complete search history.

(56) References Cited

U.S. PATENT DOCUMENTS 3,054,549 A * 9/1962 Humphrey ..... 229/117.3
3,119,544 A * 1/1964 Cope et al. ..... 229/117.16
3,426,955 A 2/1969 Olson
4,560,090 A 12/1985 Okushita
4,696,840 A 9/1987 McCullough et al.
4,796,788 A 1/1989 Bond
4,815,631 A 3/1989 Eeg et al. ..... 220/403
5,074,429 A 12/1991 Konkel et al.
5,203,470 A 4/1993 Brown
5,497,899 A 3/1996 Wuerfel ..... 220/465
5,555,996 A 9/1996 Lang-Ree et al.
5,562,227 A 10/1996 Takezawa et al.
5,860,555 A 1/1999 Mayled
6,715,634 B2 4/2004 Knol ..... 221/45
D521,378 S 5/2006 Reid
2006/0180643 A1* 8/2006 Stephenson ..... 229/117.3
2006/0202004 A1* 9/2006 Holt ..... 229/117.3
2007/0228127 A1* 10/2007 Gardner ..... 229/122.23

* cited by examiner

*Primary Examiner*—Nathan J Newhouse
*Assistant Examiner*—Christopher Demeree
(74) *Attorney, Agent, or Firm*—Merchant & Gould; Ryan T. Grace

(57) ABSTRACT

The present invention is a liquid-in-box container. A liquid-in-box container in accordance with the present invention may comprise: (a) a box; (b) a liquid-containing receptacle; (c) a spout; (d) a spout outlet aperture; (e) a first hand-hold aperture; (f) a second hand-hold aperture; (g) a third hand-hold aperture; and (h) a fourth hand-hold aperture.

31 Claims, 4 Drawing Sheets

LIQUID-IN-BOX CONTAINER

FIELD OF THE INVENTION

This invention relates generally to liquid-in-box packaging systems and, more particularly, to an ergonomic handle configuration therefore.

BACKGROUND OF THE INVENTION

As is known in the art, jug-in-box or bag-in-box containers have a rigid outer protective shell, usually in the form of a box formed of corrugated board, paperboard or other inexpensive material. Contained within the protective shell is a flexible jug, liner or bag which usually has a dispensing means, such as a spout, integrally attached and in communication with the interior of the jug, liner or bag. The jug, liner or bag is protected by the protective shell and can contain any pourable fluid material that is compatible with the material used to form the liner. Typically the pouring means is located within the protective box during shipping and can be exposed by opening the box, often by means of a punch out in one wall of the box that can be removed.

For small packages, the bag-in-box concept works quite well. However, for large size containers, the weight and bulk of the package make pouring and handling difficult. There have been numerous proposals for providing handles and hand-holds to these larger bag-in-box containers. However, these prior designs have numerous disadvantages, including manufacturing difficulty, cost and difficulty of consumer use.

Current bulk liquid packaging containers (jug-in-box or bag-in-box) have very poor ergonomics designs. Jug-in-box containers commonly have only one handle on the top of the box for the purpose of carrying the container. However, this configuration permits only one hand to grasp the handle for carrying and provides no functionality with respect to pouring the liquid contained therein.

Current bag-in-box designs may have two handles where both handles are located near the top of the respective front and back panels of a container. This configuration allows for easier carrying as it provides a mechanism for grasping the container with both hands. However, the two-handle system provides no advantage in pouring as the repositioning of a user's hands may be required in order to fully empty the container.

Therefore, it would be desirable to provide a bag-in-box and jug-in-box container having a plurality of ergonomically positioned handles which allow for a user to change grips as a liquid is progressively emptied from the container.

SUMMARY OF THE INVENTION

Accordingly, the present invention is directed to a liquid-in-box container.

In an embodiment of the invention, a liquid-in-box container may comprise: (a) a box; (b) a liquid-containing receptacle; (c) a spout; (d) a spout outlet aperture; (e) a first hand-hold aperture; (f) a second hand-hold aperture; (g) a third hand-hold aperture; and (h) a fourth hand-hold aperture.

In a further embodiment of the invention, a bliss-type box may comprise: (a) a first box blank; and (b) a second box blank, wherein the first box blank may comprise: (i) a first front panel; (ii) a second front panel; (iii) a bottom panel; (iv) a rear panel; and (v) a top panel, and wherein the second box blank may comprise: (vi) a first front flap; (vii) a first side panel; (viii) a rear panel; (ix) a second side panel; (x) a plurality of top flaps; (xi) a plurality of bottom flaps; and (xii) a second front flap.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Figure 1:
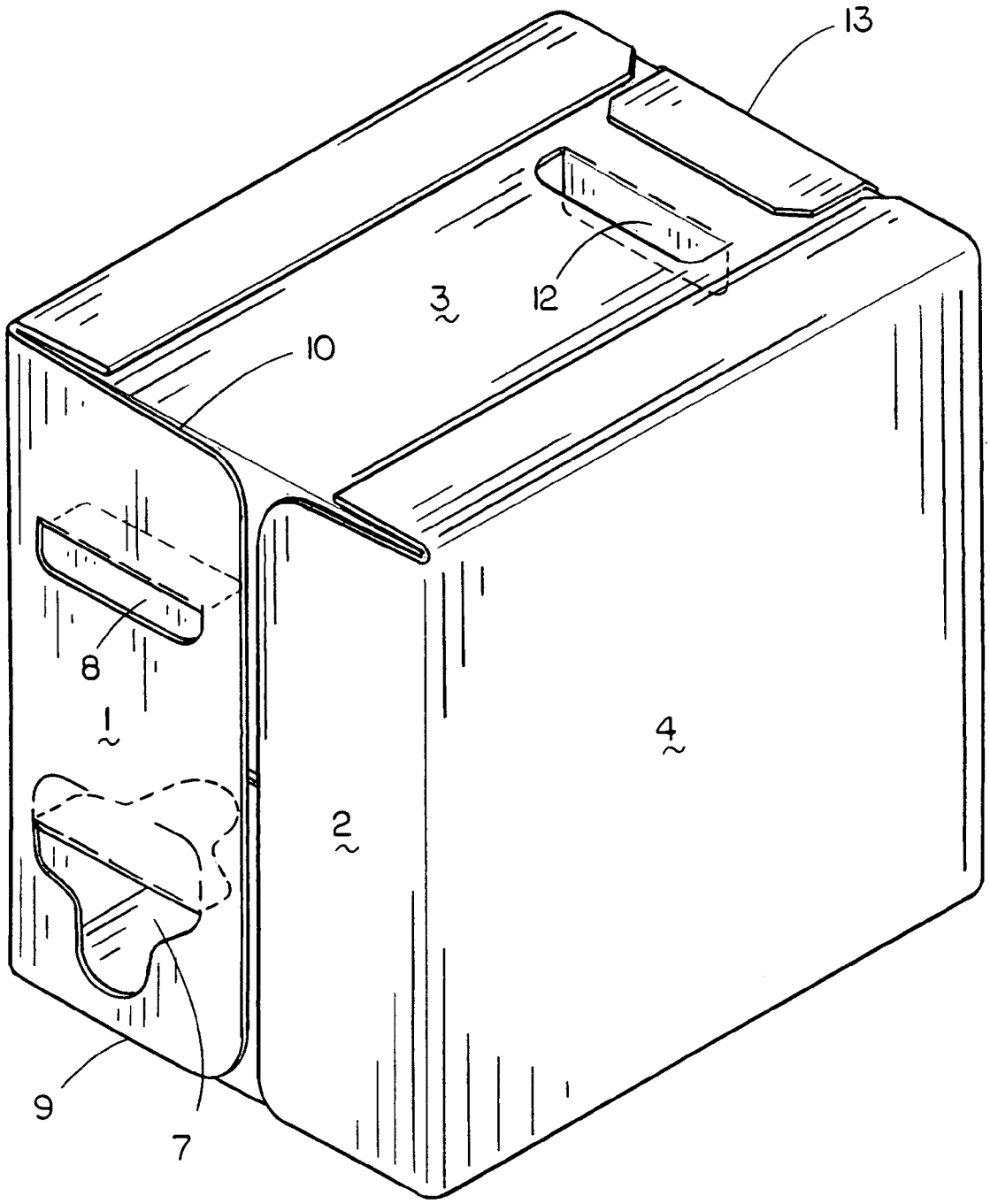
FIG. 1 depicts an axonometric view of a liquid-in-box container in accordance with an embodiment of the present invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings.

Reference will now be made, in detail, to presently preferred embodiments of the invention. Additional details of the invention are provided in the examples illustrated in the accompanying drawings.

Figure 2:
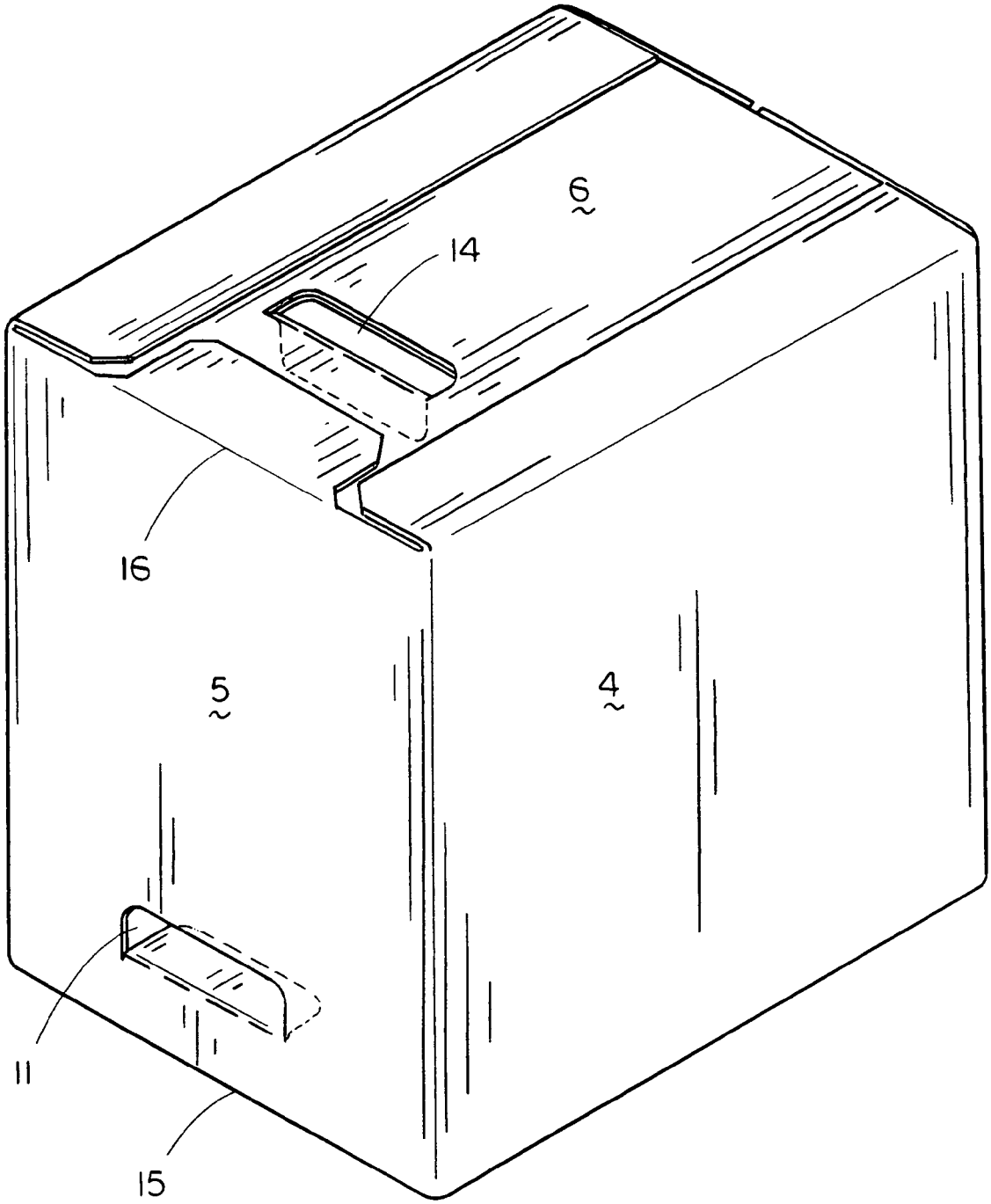
FIG. 2 depicts an axonometric view of a liquid-in-box container in accordance with an embodiment of the present invention.

Referring to FIGS. 1 and 2, axonometric views of a liquid-in-box container in accordance with the present invention are disclosed. The container may comprise a first front panel 1, a second front panel 2, a top panel 3, a pair of side panels 4, a rear panel 5, and a bottom panel 6. The panels may be comprised of a rigid material such as paper board, plastic, or other material common in the art.

The first front panel 1 may include a spout outlet aperture 7 and a front hand-hold aperture 8. The spout outlet aperture 7 may be disposed near the bottom edge 9 of the first front panel 1 so as to permit easy dispensing of a liquid from the container by use of the gravitational flow of the liquid. The first hand-hold aperture 8 may be disposed near the top edge 10 of the first front panel 1 so as to permit easy carrying of the container when used in conjunction with a second hand-hold aperture 11 disposed in the rear panel 5. Additionally, the front hand-hold aperture 8 may be used in concert with other hand-hold apertures to facilitate easy pouring of the contained liquid from the spout outlet aperture 7.

The top panel 3 may include a top hand-hold aperture 12. The top hand-hold aperture 12 may be disposed near the rear edge 13 of the top panel 3. The top hand-hold aperture 12 may be used in connection with a bottom hand-hold aperture 14 disposed in the bottom panel 6 to facilitate easy pouring of the contained liquid from the spout outlet aperture 7 when very little liquid remains in the container.

The rear panel 5 may include a rear hand-hold aperture 11. The rear hand-hold aperture 11 may be disposed near the top edge 15 of the rear panel 5 so as to permit easy carrying of the container when used with the front hand-hold aperture 8 disposed in the first front panel 1. Additionally, the rear hand-hold aperture 11 may be used in concert with the front hand-hold aperture 8 to facilitate easy pouring of the contained liquid when the container is nearly full.

The bottom panel 6 may include the bottom hand-hold aperture 14. The bottom hand-hold aperture 14 may be disposed near the rear edge 16 of the bottom panel 6. The bottom hand-hold aperture 14 may be used in connection with the front hand-hold aperture 8 disposed in the first front panel 1 to facilitate easy pouring of the contained liquid from the spout outlet aperture 7 when a moderate amount of liquid remains in the container. As stated above, the bottom hand-hold aperture 14 may also be used in connection with the top hand-hold aperture 12 disposed in the top panel 3 to facilitate easy pouring of the contained liquid from the spout outlet aperture 7 when very little liquid remains in the container.

In a further embodiment of the present invention, the liquid-in-box container may be a bliss-type container comprising at least one inner portion and an outer portion disposed around the inner portion or portions. Bliss-type containers offer many advantages, most notably that they are stronger than most containers due to their having double and triple wall thicknesses. This makes bliss-type containers particularly advantageous for shipping and storage purposes.

Figure 3:
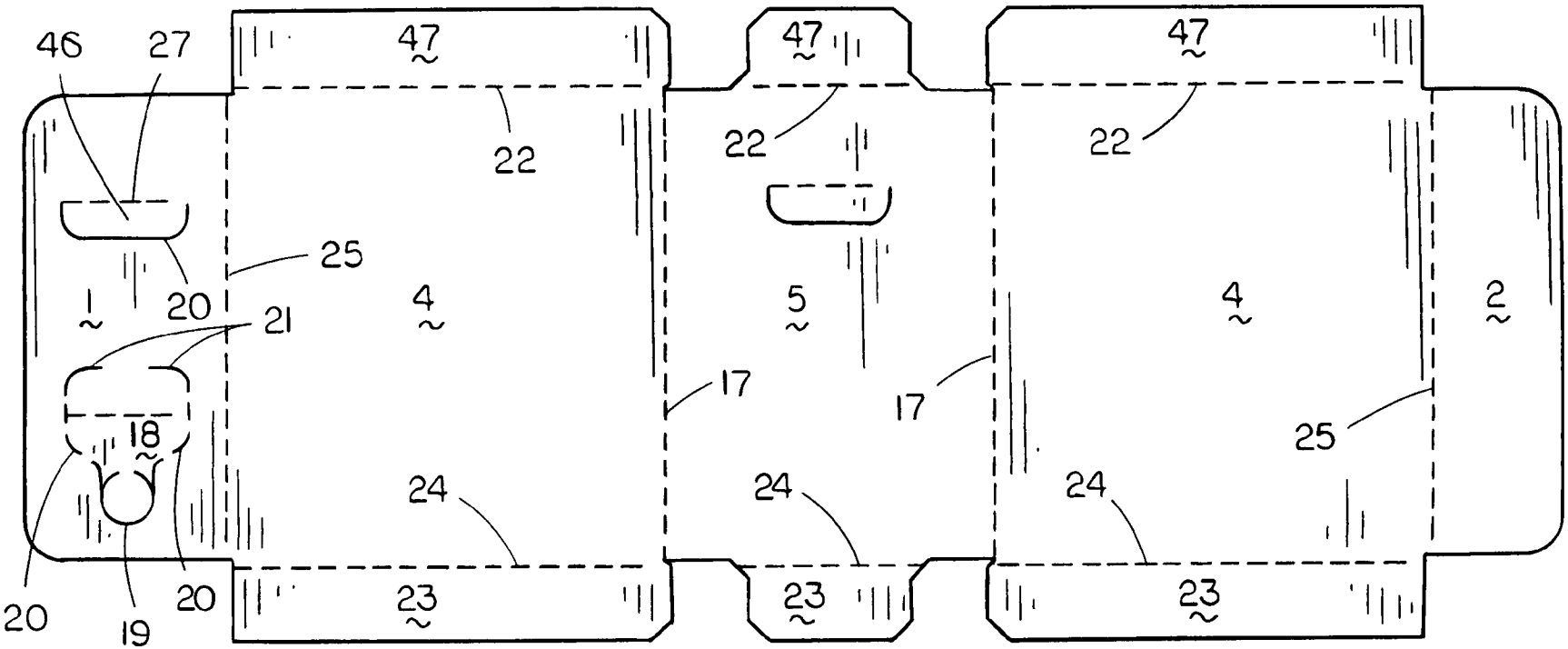
FIG. 3 depicts a box blank for an outer portion of a bliss-type liquid-in-box container in accordance with an embodiment of the present invention.

Referring to FIG. 3, a box blank for an outer portion of a bliss-type container in accordance with the present invention is disclosed. The box blank may comprise side panels 4, and a rear panel 5. The box blank may be formed into the outer portion of the bliss-type container by folding along score lines 17. A top panel may be formed by folding top flaps 47 along score lines 22. A bottom panel may be formed by folding bottom flaps 23 along score lines 24. A first front panel 1 and a second front panel 2 may be folded along score lines 25.

The box blank may comprise an outer spout outlet flap 18 defined by cut lines 19 and 20 and score line 21. A spout outlet aperture 7 may be formed by removing the circular portion of the outer spout outlet flap 18 defined by cut line 19 and folding the portion of the outer spout outlet flap 18 defined by cut lines 20 into the interior of the container along score line 21. Once the spout outlet aperture 7 is formed, the spout of the jug or bag portion of the liquid-in-box container may be disposed in the void created by the removal of the circular portion of the outer spout outlet flap 18 defined by cut line 19. The remainder of the outer spout outlet flap 18 defined by cut lines 20 may be returned to its original position so as to fix the position of the jug or bag spout.

The box blank may also comprise an outer front hand-hold flap 46 defined by cut line 26 and score line 27 and an outer rear hand-hold flap 20 defined by cut line 28 and score line 29. A front hand-hold aperture 8 may be formed by bending the outer front hand-hold flap 46 into the interior of the container along score line 27. A rear hand-hold aperture 11 may be formed by bending the outer rear hand-hold flap 20 into the interior of the container along score line 29.

Figure 4:
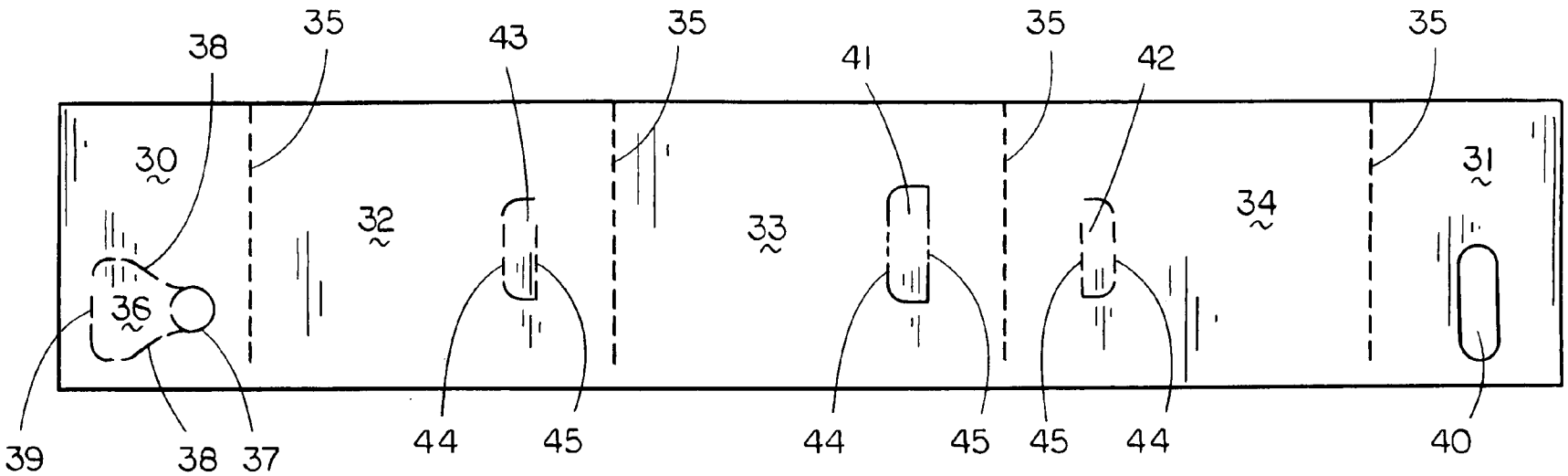
FIG. 4 depicts a box blank for an inner portion of a bliss-type liquid-in-box container in accordance with an embodiment of the present invention.

Referring to FIG. 4, a box blank for an inner portion of a bliss-type container in accordance with the present invention is disclosed. The box blank may comprise a first inner front panel 30, a second inner front panel 31, an inner bottom panel 32, an inner rear panel 33, and an inner top panel 34. The box blank may be formed into the inner portion of a bliss-type container by folding along score lines 35.

The box blank may comprise an inner spout outlet flap 36 defined by cut lines 37 and 38 and score line 39. A spout outlet aperture 7 may be formed by removing the portion of the inner spout outlet flap 36 defined by cut line 37 and folding the portion of the inner spout outlet flap 36 defined by cut lines 38 into the interior of the container along score line 39. Once the spout outlet aperture 7 is formed, the spout of the jug or bag portion of a liquid-in-box container may be disposed in the void created by the removal of the portion of the spout outlet flap defined by cut lines 37. The remainder of the inner spout outlet flap 36 defined by cut lines 38 may be returned to its original position so as to fix the position of the jug or bag spout.

The box blank may also comprise an inner front hand-hold aperture 40 disposed in the second inner front panel 31.

The box blank may also comprise an inner rear hand-hold flap 41, an inner top hand-hold flap 42, and an inner bottom hand-hold flap 43. The rear 41, top 42 and bottom 43 inner hand-hold flaps may be defined by cut lines 44 and score lines 45. Rear 11, top 12, and 14 hand-hold apertures may be formed by folding the rear 41, top 42 and bottom 43 inner hand-hold flaps into the interior of the container along score lines 45.

The outer and inner portions of a bliss-box type container formed from the box blanks disclosed in FIGS. 3 and 4 respectively may be combined to create a complete bliss-box type container for receiving a jug or bag for a liquid-in-box system. Once the outer and inner portions are independently assembled as described above, they may be combined by connecting certain elements of the outer and inner portions. Such connections may be by mechanical means such as staples, by adhesive means such as glues, tapes or other chemical bonding agents, or other mechanisms common to the art.

The top flaps 47 of the outer portion may be connected to the inner top panel 34 of the inner portion. The bottom flaps 23 of the outer portion may be connected to the inner bottom panel 32 of the inner portion. The first front panel 1 and the second front panel 2 may be connected to the first inner front panel 30 and second inner front panel 31

The outer and inner portions may be combined such that the outer spout outlet flap 18 and the inner spout outlet flap 36 are aligned. When the portions of the outer flap 18 and inner flap 36 defined by cut lines 19 and 37 are removed, a spout outlet aperture 7 is formed. Such a configuration provides a mechanism for fixing the position of the jug or bag spout of the liquid-in-box container. This use of more than one layer of container material provides additional support and stability for the spout.

The outer and inner portions may be combined such that the outer front hand-hold flap 46 and the inner front hand-hold aperture 40 are aligned. In such a configuration, the outer front hand-hold flap 46 may be folded through the inner front hand-hold aperture 40 into the interior of the container to form a single hand-hold.

Similarly, the outer and inner portions may be combined such that the outer rear hand-hold flap 20 and the inner rear hand-hold flap 41 are aligned. In such a configuration, the outer rear hand-hold flap 20 and the inner rear hand-hold flap 41 may both be folded into the interior of the container to form a single hand-hold.

It is believed that the present invention and many of its attendant advantages will be understood from the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A liquid-in-box container comprising:

a box assembly having:

a first structure including:

a front panel including a first spout outlet flap that defines a first spout outlet aperture, the front panel of the first structure defining a first front hand-hold aperture;

a bottom panel connected to the front panel of the first structure, the bottom panel of the first structure defining a first bottom hand-hold aperture;

a rear panel connected to the bottom panel of the first structure, the rear panel of the first structure defining a first rear hand-hold aperture;

a top panel connected to the rear panel of the first structure, the top panel of the first structure defining a first top hand-hold aperture;

a second structure including:

a front panel including a second spout outlet flap that defines a second spout outlet aperture, the front panel of the second structure defining a second front hand-hold aperture;

a first side panel connected to the front panel of the second structure;

a rear panel connected to the first side panel, the rear panel of the second structure defining a second rear hand-hold aperture;

a second side panel connected to the rear panel of the second structure;

wherein the first structure is combined with the second structure so that the first and second spout outlet apertures, the first and second front hand-hold apertures and the first and second rear hand-hold apertures are aligned;

a liquid-containing receptacle disposed in the box assembly, the liquid-containing receptacle including a spout that extends through the first and second spout outlet apertures of the first and second structures of the box assembly, wherein the first and second spout outlet flaps fix the position of the spout in the first and second spout outlet apertures.

2. The liquid-in-box container of claim 1, wherein the liquid-containing receptacle is selected from the group consisting of a bag, a liner, and a jug.

3. The liquid-in-box container of claim 2, wherein the liquid-containing receptacle is operably coupled to the spout.

4. The liquid-in-box container of claim 1, wherein the front panel of the first structure includes:

a first front panel; and a second front panel.

5. The liquid-in-box container of claim 4, wherein the first spout outlet flap is disposed in the first front panel and defined by spout outlet cut lines and a spout outlet score line.

6. The liquid-in-box container of claim 1, wherein the first front hand-hold aperture is disposed in the second front panel.

7. The liquid-in-box container of claim 1, wherein the first front hand-hold aperture includes a first front hand-hold flap defined by first front hand-hold cut lines and a first front hand-hold score line.

8. The liquid-in-box container of claim 1, wherein the first bottom hand-hold aperture includes a first bottom hand-hold flap defined by first bottom hand-hold cut lines and a first bottom hand-hold score line.

9. The liquid-in-box container of claim 1, wherein the first rear hand-hold aperture includes a first rear hand-hold flap defined by first rear hand-hold cut lines and a first rear hand-hold score line.

10. The liquid-in-box container of claim 1, wherein the first top hand-hold aperture includes a first top hand-hold flap defined by first top hand hold-cut lines and a first top hand-hold score line.

11. The liquid-in-box container of claim 1, wherein the front panel of the second structure is formed from a first front flap and a second front flap.

12. The liquid-in-box container of claim 11, wherein the second spout outlet flap is disposed in the first front flap and defined by spout outlet cut lines and a spout outlet score line.

13. The liquid-in-box container of claim 11, wherein the second front hand-hold aperture is disposed in the first front flap and includes a second front hand-hold flap defined by second front hand-hold cut lines and a second front hand-hold score line.

14. The liquid-in-box container of claim 1, wherein the second rear hand-hold aperture includes a second rear hand-hold flap defined by second rear hand-hold cut lines and a second rear hand-hold score line.

15. A method for assembling a liquid-in-box container, the method comprising:

providing a first blank having:

a front panel including a first spout outlet flap;

a bottom panel connected to the front panel of the first blank at a first score line, the bottom panel defining a first bottom hand-hold aperture;

a rear panel connected to the bottom panel of the first blank at a second score line, the rear panel defining a first rear hand-hold aperture;

a top panel connected to the rear panel of the first blank at a third score line, the top panel defining a first top hand-hold aperture;

providing a second blank having:

a front panel including a second spout outlet flap and defining a second front hand-hold aperture;

a first side panel connected to the front panel of the second blank at a first score line;

a rear panel connected to the first side panel of the second blank at a second score line, the rear panel defining a second rear hand-hold aperture;

a second side panel connected to the rear panel of the second blank at a third score line;

forming a first structure by folding the first blank at the first, second and third score lines of the first blank;

forming a second structure by folding the second blank at the first, second and third score lines of the second blank; and combining the first and second structures so that the first spout outlet flap of the structure is aligned with the second spout outlet flap of the second structure.

16. The method of claim 15, further comprising connecting the first structure to the second structure with a connection mechanism selected from the group consisting of staples, adhesive and chemical bonding agent.

17. The method of claim 15, further comprising removing a portion of each of the first and second spout outlet flaps to form a spout outlet aperture.

18. The method of claim 17, further comprising inserting a liquid-containing receptacle in the first structure so that a spout of the liquid-containing receptacle passes through the spout outlet aperture.

19. The method of claim 18, wherein remaining portions of the first and second spout outlet flaps fix the position of the spout of the liquid-containing receptacle.

20. A liquid-in-box container comprising:

a box assembly having:

a first structure including:

a front panel including a first spout outlet flap that defines a first spout outlet aperture, the front panel of the first structure defining a first front hand-hold aperture;

a bottom panel connected to the front panel of the first structure, the bottom panel of the first structure defining a first bottom hand-hold aperture;

a rear panel connected to the bottom panel of the first structure, the rear panel of the first structure defining a first rear hand-hold aperture;

a top panel connected to the rear panel of the first structure, the top panel of the first structure defining a first top hand-hold aperture;

a second structure including:

a front panel including a second spout outlet flap that defines a second spout outlet aperture, the front panel of the second structure defining a second front hand-hold aperture;

a first side panel connected to the front panel of the second structure;

a rear panel connected to the first side panel, the rear panel of the second structure defining a second rear hand-hold aperture;

a second side panel connected to the rear panel of the second structure; and wherein the first structure is combined with the second structure so that the first and second spout outlet apertures, the first and second front hand-hold apertures and the first and second rear hand-hold apertures are aligned.

21. The liquid-in-box container of claim 20, wherein the front panel of the first structure includes:

a first front panel; and a second front panel.

22. The liquid-in-box container of claim 21, wherein the first outlet flap is disposed in the first front panel and defined by spout outlet cut lines and a spout outlet score line.

23. The liquid-in-box container of claim 21, wherein the first front hand-hold aperture is disposed in the second front panel.

24. The liquid-in-box container of claim 20, wherein the first front hand-hold aperture includes a first front hand-hold flap defined by first front hand-hold cut lines and a first front hand-hold score line.

25. The liquid-in-box container of claim 20, wherein the first bottom hand-hold aperture includes a first bottom hand-hold flap defined by first bottom hand-hold cut lines and a first bottom hand-hold score line.

26. The liquid-in-box container of claim 20, wherein the first rear hand-hold aperture includes a first rear hand-hold flap defined by first rear hand-hold cut lines and a first rear hand-hold score line.

27. The liquid-in-box container of claim 20, wherein the first top hand-hold aperture includes a first top hand-hold flap defined by first top hand hold-cut lines and a first top hand-hold score line.

28. The liquid-in-box container of claim 20, wherein the front panel of the second structure is formed from a first front flap and a second front flap.

29. The liquid-in-box container of claim 28, wherein the second spout outlet flap is disposed in the first front flap and defined by spout outlet cut lines and a spout outlet score line.

30. The liquid-in-box container of claim 28, wherein the second front hand-hold aperture is disposed in the first front flap and includes a second front hand-hold flap defined by second front hand-hold cut lines and a second front hand-hold score line.

31. The liquid-in-box container of claim 20, wherein the second rear hand-hold aperture includes a second rear hand-hold flap defined by second rear hand-hold cut lines and a second rear hand-hold score line.

* * * * *